United States Patent [19]

Jenkins

[11] Patent Number: 4,731,804

[45] Date of Patent: Mar. 15, 1988

[54] WINDOW CONFIGURATION OF AN X-RAY TUBE

[75] Inventor: Ronald Jenkins, Peekskill, N.Y.

[73] Assignee: North American Philips Corporation, New York, N.Y.

[21] Appl. No.: 6,323

[22] Filed: Jan. 14, 1987

Related U.S. Application Data

[63] Continuation of Ser. No. 688,098, Dec. 31, 1984, abandoned.

[51] Int. Cl.[4] ..... H01J 35/18

[52] U.S. Cl. ..... 378/140; 378/127; 378/141; 378/161

[58] Field of Search ..... 378/127, 140–141, 378/161

[56] References Cited

U.S. PATENT DOCUMENTS

| | | | |
|---|---|---|---|
| 2,310,567 | 2/1943 | Atlee et al. | 378/140 |
| 2,394,984 | 2/1946 | Claussen | 378/140 |
| 2,663,812 | 12/1953 | Jamison et al. | 378/140 |
| 4,178,509 | 12/1979 | More et al. | 378/140 |
| 4,344,181 | 8/1982 | Baecklund | 378/45 |

FOREIGN PATENT DOCUMENTS

| | | | |
|---|---|---|---|
| 0095093 | 6/1982 | Japan | 378/140 |
| 0018900 | 2/1983 | Japan | 378/141 |
| 530458 | 12/1940 | United Kingdom | 378/140 |

*Primary Examiner*—Craig E. Church
*Assistant Examiner*—John C. Freeman
*Attorney, Agent, or Firm*—Paul R. Miller

[57] ABSTRACT

The present invention is directed to an improved spectographic X-ray tube in which heat dissipation through the beryllium window of the X-ray tube is improved by way of a thin layer disposed on the inside of the beryllium window. The coating layer is of copper and disposed on the inside of the beryllium window for the best effects for improving heat dissipation by the window.

5 Claims, 2 Drawing Figures

WINDOW CONFIGURATION OF AN X-RAY TUBE

Figure 1:
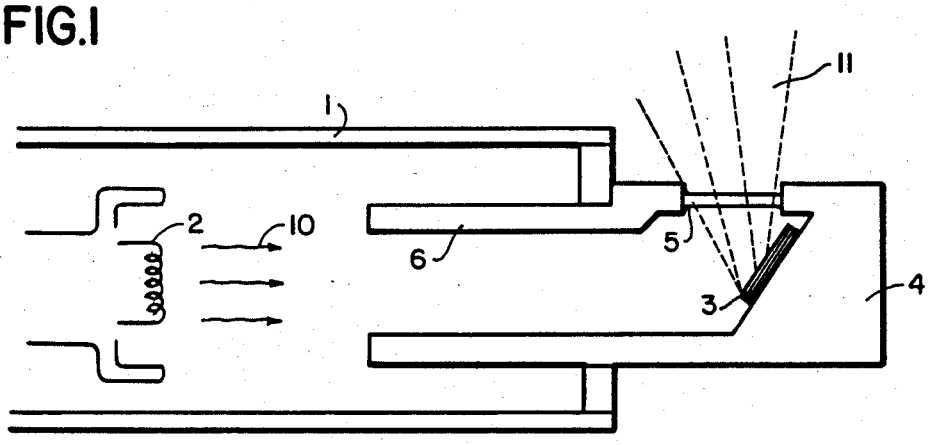

This application is a continuation of U.S. application Ser. No. 688,098, filed Dec. 31, 1984, now abandoned, and all benefits of such earlier application are hereby claimed.

The present invention is directed to an improved X-ray tube, particularly for spectrographic use, wherein heat dissipation is improved. More particularly, the exit window for X-rays of the X-ray tube is coated by way of a thin heat conducting layer to improve heat dissipation.

An important consideration in constructing X-ray tubes involves the reduction of heat generated by an electron beam striking the anode structure. The electron beam is generated through a cathode structure of the tube, and regardless of what other structures the X-ray tube contains, heat is generated by the anode upon being struck by the electron beam.

Two areas of heat dissipation have been considered to be important in X-ray tube construction. First, is the heat dissipation through the anode structure to a copper anode block on which the anode is disposed. Secondly, is the consideration of heat dissipation by the window of the X-ray tube by electrons scattered from the anode. Principally, a beryllium window has been used in X-ray tubes for exit windows, and it has been found that scatter from a copper tube forming part of the copper anode block causes significant heating of the beryllium window.

Beryllium is a poor conductor of heat and the high temperature gradients formed across the window due to electron backscatter may cause the window to rupture. Accordingly, this heating problem becomes the effective wattage loading of the X-ray tube.

The presently claimed invention has found that heat dissipation across the beryllium window can be reduced by deposition of a thin layer to the inside of the window structure.

In particular, it has been found that a thin coating layer having a thickness ranging from about 500 to 1,000 angstroms is extremely effective for reducing the effects of heat dissipation across the window, thus allowing increased wattage loading on the tube.

Further, it has been found that the use of a thin coating layer of copper is very effective for reducing the effect of heat dissipation through the anode.

Figure 2:
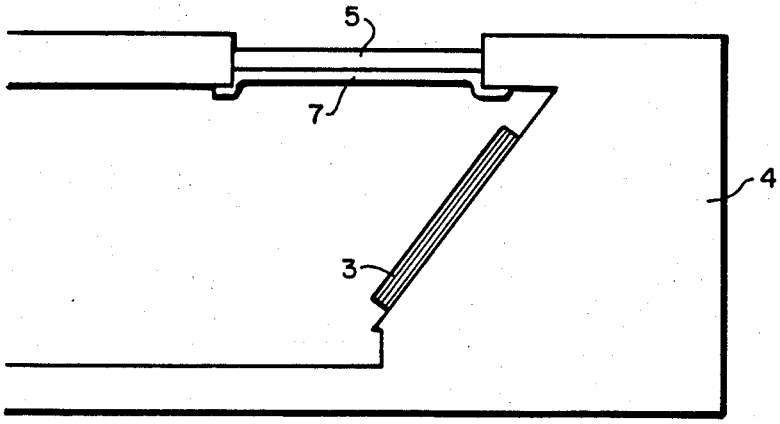

The features and advantages of the present invention will be described in more detail, by way of example, with reference to the drawing figures, in which:

FIG. 1 illustrates a portion of an X-ray tube at which X-rays are produced; and FIG. 2 is a closer view of FIG. 1 to show the operation of the present invention in an X-ray tube.

FIG. 1 illustrates the structure of an X-ray tube particularly useful in spectrographic devices. The X-ray tube 1 includes a cathode structure 2 and an anode structure 3. During operation of the X-ray tube, an electron beam 10 is directed from the cathode to the anode to produce X-rays 11, as schematically shown in FIG. 1.

In the structure of the X-ray tube shown in FIG. 1, the anode 3 is mounted on a copper anode block 4 which improves the heat dissipation of the structure. The copper anode block 4 includes a copper plated tube 6 which extends through the X-ray tube 1 toward the cathode. A window 5 is located in the copper anode block and copper plated tube to pass the X-rays 11 to the outside of the X-ray tube 1. A typical window would be of beryllium.

In accordance with the present invention, as seen in FIG. 2, a coating layer 7 is provided on the beryllium window 5 so as to improve heat dissipation through the anode 3 to the copper anode block 4. This coating layer 7 is a thin layer, in the range of about 500 to 1000 angstroms, of copper. In addition, the coating layer 7 can be of the same material as the anode 3. Further, it has been found to be very effective for heat dissipation to apply the coating layer 7 to the inside of the beryllium window.

The use of this coating layer has been found to allow increase of the loading of the X-ray tube by improving the heat dissipation. The loading of a spectrographic X-ray tube is limited by heat dissipation occurring through the anode to the copper anode block, and heating the beryllium window of the tube due to backscattered elections. The use of the copper plated tube 6, which is a part of the copper anode block 4, maximizes the heat dissipation by the beryllium window. Further, the use of the thin coating layer of copper on the beryllium window improves the heat dissipation of the window. These effects substantially improve the use of an X-ray tube for spectrographic purposes.

What I claim:

1. In an X-ray tube comprising a cathode means for generating electrons, an anode means receiving said electrons for emitting X-rays, a beryllium window separated from said anode means for passing said X-rays, wherein said anode means is mounted on a copper anode block, the improvement comprises a coating layer disposed over the entire surface of said beryllium window for improving heat dissipation by said window upon receiving X-rays from said anode means, wherein said coating layer is a material the same as said anode means, and wherein said coating layer has a thickness ranging from about 500 to 1000 angstroms.

2. An X-ray tube according to claim 1, wherein said coating layer is copper.

3. An X-ray tube according to claim 2, wherein said coating layer is disposed on the side of said beryllium window facing said anode means.

4. An X-ray tube according to claim 1, wherein said coating layer is disposed on the side of said beryllium window facing said anode means.

5. An X-ray tube according to claim 1, wherein said copper anode block includes a copper plated tube open at one end and extending in facing relationship toward said cathode means, said copper anode block being disposed at an opposite end of said tube, said coating layer and said beryllium window being at a side of said tube in facing relationship to at least one anode structure disposed on said copper anode block.

* * * * *